US007977296B2

(12) United States Patent
Oldenhove et al.

(10) Patent No.: US 7,977,296 B2
(45) Date of Patent: Jul. 12, 2011

(54) LIQUID DETERGENT COMPOSITION COMPRISING AN ACRYLIC POLYMER/VISCOSITY CONTROL AGENT MIXTURE

(75) Inventors: Louis Oldenhove, Liege (BE); Germaine Zocchi, Villers aux Tours (BE); Daniel Van De Gaer, Verlaine (BE); Guy Broze, Grace-Hollogne (BE)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 12/778,176

(22) Filed: May 12, 2010

(65) Prior Publication Data

US 2010/0222249 A1 Sep. 2, 2010

Related U.S. Application Data

(63) Continuation of application No. 12/159,697, filed as application No. PCT/US2007/086988 on Dec. 10, 2007, now Pat. No. 7,749,949.

(60) Provisional application No. 60/870,296, filed on Dec. 15, 2006, provisional application No. 60/870,496, filed on Dec. 18, 2006.

(51) Int. Cl.
*C11D 1/12* (2006.01)
*C11D 3/37* (2006.01)
*C11D 1/94* (2006.01)

(52) U.S. Cl. ..... 510/235; 510/421; 510/427; 510/434; 510/438; 510/470; 510/426

(58) Field of Classification Search ..... 510/235, 510/421, 426, 427, 434, 438, 470
See application file for complete search history.

(56) References Cited

U.S. PATENT DOCUMENTS 4,457,856 A 7/1984 Mitchelll et al.
4,486,405 A 12/1984 Klein
5,030,374 A 7/1991 Tranner
5,384,118 A 1/1995 LaValle
5,425,806 A 6/1995 Doolan et al.
5,534,265 A 7/1996 Fowlet et al.
5,554,321 A 9/1996 Choy et al.
5,681,801 A 10/1997 Zocchi
5,710,177 A 1/1998 Sauermann et al.
5,750,489 A 5/1998 Garcia et al.
5,846,454 A * 12/1998 Koczo et al. ..... 516/11
5,849,310 A * 12/1998 Trinh et al. ..... 424/401
5,866,529 A 2/1999 Erilli et al.
5,977,053 A 11/1999 Groth et al.
6,033,680 A 3/2000 Dixon et al.
6,051,541 A 4/2000 Neuser et al.
6,106,738 A 8/2000 Woo et al.
6,150,313 A 11/2000 Harmalker et al.
6,165,510 A 12/2000 Baines et al.
6,268,330 B1 7/2001 Leonard et al.
6,294,179 B1 9/2001 Lee et al.
6,294,509 B1 9/2001 Meiwa et al.
6,339,058 B1 1/2002 Toussaint et al.
6,362,156 B1 3/2002 Hsu et al.
6,369,018 B1 4/2002 Hsu et al.
6,380,150 B1 4/2002 Toussaint et al.
6,533,873 B1 3/2003 Margosiak et al.
6,635,702 B1 10/2003 Schmucker-Casatner et al.
6,638,519 B1 10/2003 Lorant
6,642,198 B2 11/2003 Pflederer et al.
6,682,723 B2 1/2004 Parry et al.
6,730,292 B1 * 5/2004 Yang et al. ..... 424/70.11
6,767,875 B1 * 7/2004 Snyder et al. ..... 510/119
6,767,878 B1 7/2004 Paye et al.
6,770,612 B1 8/2004 Hatchman
6,846,785 B2 1/2005 Patet et al.
6,849,588 B2 2/2005 Elsik et al.
6,927,201 B2 8/2005 Hsu et al.
6,972,278 B2 12/2005 Hsu et al.
7,001,594 B1 2/2006 Peffly et al.
7,022,657 B2 4/2006 Hines et al.
D529,398 S 10/2006 Van Dingenen
7,186,675 B2 3/2007 Meine et al.
7,259,131 B2 * 8/2007 Fan et al. ..... 510/119
2001/0021388 A1 9/2001 Motitschke et al.
2001/0056049 A1 12/2001 Aronson et al.
2002/0039561 A1 4/2002 Doughty et al.
2002/0123438 A1 9/2002 Pflederer et al.
2002/0142013 A1 10/2002 Maes et al.
2002/0165198 A1 11/2002 Singh et al.

(Continued)

FOREIGN PATENT DOCUMENTS

CA 2306376 10/2000

(Continued)

OTHER PUBLICATIONS

Svelto Gel Microgranuli Strawberry Product Information retrieved from www.Unilever.com.
Analysis of Cif Gel product sold in Europe.
Analysis of Svelto Gel product sold in Europe.
copending U.S. Appl. No. 12/024,200, filed Feb. 1, 2008.
International Search Report Dated Jan. 3, 2008.
File History From U.S. Appl. No. 11/558,701.
File History For U.S. Appl. No. 11/532,227.
File History for U.S. Appl. No. 12/354,809.
File History for U.S. Appl. No. 11/627,048.
File History for U.S. Appl. No. 12/396,007.
File History for U.S. Appl. No. 12/024,200.
Noveon Carbopol Aqua SF-1 Polymer Summary Sheet CP-29, Nov. 2002.
Noveon Carbopol Aqua SF-1 Polymer Technical Data Sheet TDS-294, Jul. 2003.
Glucam E-10 Methyl Glucoside Derivative Technical Data Sheet, Noveon, Aug. 1, 2005.

(Continued)

*Primary Examiner* — Charles I Boyer
(74) *Attorney, Agent, or Firm* — Michael F. Morgan

(57) ABSTRACT

A composition comprising a liquid portion comprising at least one surfactant, at least one suspending agent, and at least one viscosity control agent, wherein the composition has an apparent viscosity under a shear stress of 0.5 Pa of at least about 1,000 Pa·s; and the composition has an apparent viscosity under a shear stress of 100 Pa of less than about 10 Pa·s. The composition is capable of suspending materials, but it still has desired rheological properties.

12 Claims, 4 Drawing Sheets

U.S. PATENT DOCUMENTS

| | | | | |
|---|---|---|---|---|
| 2003/0044442 | A1 | 3/2003 | Stanier et al. | |
| 2003/0100464 | A1 | 5/2003 | Kott et al. | |
| 2003/0108504 | A1* | 6/2003 | Sako et al. | 424/70.12 |
| 2003/0171230 | A1 | 9/2003 | Shana'a et al. | |
| 2003/0180246 | A1* | 9/2003 | Frantz et al. | 424/70.21 |
| 2003/0199593 | A1 | 10/2003 | Pereira et al. | |
| 2004/0018950 | A1 | 1/2004 | Foley et al. | |
| 2004/0186037 | A1 | 9/2004 | Cheung et al. | |
| 2004/0191285 | A1 | 9/2004 | Bassi et al. | |
| 2004/0223929 | A1 | 11/2004 | Clapp et al. | |
| 2004/0223993 | A1 | 11/2004 | Clapp et al. | |
| 2004/0234565 | A1 | 11/2004 | Stella et al. | |
| 2004/0235690 | A1 | 11/2004 | Oldenhove | |
| 2005/0020467 | A1 | 1/2005 | Kinscherf | |
| 2005/0020471 | A1 | 1/2005 | Cheung et al. | |
| 2005/0043200 | A1 | 2/2005 | Barry et al. | |
| 2005/0059568 | A1 | 3/2005 | Hines | |
| 2005/0079983 | A1 | 4/2005 | Pay | |
| 2005/0100570 | A1 | 5/2005 | Wei et al. | |
| 2005/0106112 | A1 | 5/2005 | Boyd et al. | |
| 2005/0113499 | A1* | 5/2005 | Tamcke et al. | 524/270 |
| 2005/0158268 | A1 | 7/2005 | Schmucker | |
| 2005/0170982 | A1 | 8/2005 | Boone et al. | |
| 2005/0176613 | A1 | 8/2005 | Wai et al. | |
| 2005/0192201 | A1 | 9/2005 | Cornelio Ford et al. | |
| 2005/0203213 | A1 | 9/2005 | Pommiers et al. | |
| 2005/0227880 | A1 | 10/2005 | Shiloach | |
| 2005/0245419 | A1 | 11/2005 | Guzmann et al. | |
| 2005/0272622 | A1 | 12/2005 | Hariharan et al. | |
| 2006/0019861 | A1* | 1/2006 | Potechin et al. | 510/475 |
| 2006/0019862 | A1 | 1/2006 | Allen et al. | |
| 2006/0083761 | A1 | 4/2006 | Yoshimi et al. | |
| 2006/0159638 | A1 | 7/2006 | Segura et al. | |
| 2006/0165635 | A1* | 7/2006 | Kelly et al. | 424/70.14 |
| 2006/0194709 | A1 | 8/2006 | Boone et al. | |
| 2007/0009463 | A1 | 1/2007 | Niebaurer et al. | |
| 2007/0010415 | A1 | 1/2007 | Kinscherf et al. | |
| 2007/0043119 | A1 | 2/2007 | Graeber et al. | |
| 2007/0066507 | A1 | 3/2007 | Fleckenstein et al. | |
| 2007/0116731 | A1 | 5/2007 | Astruc et al. | |
| 2007/0117736 | A1* | 5/2007 | Figger et al. | 510/421 |
| 2007/0167338 | A1 | 7/2007 | McHugh et al. | |
| 2007/0196403 | A1* | 8/2007 | Uchida et al. | 424/401 |
| 2007/0244205 | A1 | 10/2007 | Koczo et al. | |
| 2008/0045624 | A1* | 2/2008 | Losch et al. | 522/167 |
| 2008/0070823 | A1 | 3/2008 | Gorlin et al. | |
| 2008/0242581 | A1 | 10/2008 | Murphy | |
| 2009/0012002 | A1* | 1/2009 | Dal Farra et al. | 514/14 |
| 2009/0082278 | A1* | 3/2009 | Dal Farra et al. | 514/13 |
| 2009/0124527 | A1 | 5/2009 | Fleckenstein | |
| 2009/0163401 | A1 | 6/2009 | Gorlin | |
| 2010/0160457 | A1* | 6/2010 | Chuah et al. | 514/738 |

FOREIGN PATENT DOCUMENTS

| | | | |
|---|---|---|---|
| CA | 2323022 | | 4/2001 |
| EP | 0151884 | | 8/1985 |
| EP | 0452106 | | 10/1991 |
| EP | 520551 | A2 | 12/1992 |
| EP | 887071 | A1 | 12/1998 |
| EP | 1090631 | | 4/2001 |
| EP | 1364639 | | 11/2003 |
| GB | 2179364 | | 3/1987 |
| GB | 2290551 | | 1/1996 |
| GB | 2297762 | | 8/1996 |
| WO | WO91/14421 | | 10/1991 |
| WO | WO94/05757 | | 3/1994 |
| WO | WO 94/29428 | | 12/1994 |
| WO | WO97/26315 | | 7/1997 |
| WO | WO9929827 | A1 | 6/1999 |
| WO | WO99/60996 | | 12/1999 |
| WO | WO02/38720 | | 5/2002 |
| WO | WO03/099986 | | 12/2003 |
| WO | WO 2004/083353 | | 9/2004 |
| WO | WO2006/021255 | | 5/2006 |
| WO | WO2007/111888 | A1 | 10/2007 |

OTHER PUBLICATIONS

Glucam E-20 Methyl Glucoside Derivative Technical Data sheet, Noveon, Aug. 1, 2005.

Glucam P-10 Methyl Glucoside Derivative Technical Data Sheet, Noveon, Aug. 1, 2005.

Glucam P-20 Methyl Glucoside Derivative Technical Data Sheet, Noveon, Aug. 1, 2005.

Glucamate DOE-120 Methyl Glucoside Thickener Technical Data Sheet, Noveon, Jul. 14.

Glucamate LT Methyl Glucoside Thickener Technical Data Sheeet, Noveon, Jul. 14, 2006.

3V Synthalen W2000 Cosmetic Technical Report No. 6—Edition 4, undated.

International Search Report and Written Opinion for International Application No. PCT/US2007/086988 mailed on Jun. 12, 2008.

International Preliminary Report on Patentability for International Application No. PCT/US2007/086988 mailed on Jun. 25, 2009.

Updated File History for U.S. Appl. No. 12/024,200, filed Feb. 1, 2008.

* cited by examiner

LIQUID DETERGENT COMPOSITION COMPRISING AN ACRYLIC POLYMER/VISCOSITY CONTROL AGENT MIXTURE

CROSS REFERENCE TO RELATED APPLICATIONS

This application is a continuation of Ser. No. 12/159,697, filed on 31 Oct. 2008, which is a national stage entry of PCT/US2007/086988, filed on 10 Dec. 2007, which claims priority to U.S. Provisional Patent Application No. 60/870,296, filed on 15 Dec. 2006 and to U.S. Provisional Patent Application No. 60/870,496, filed on 18 Dec. 2006, all of which are incorporated herein by reference.

BACKGROUND

Structured liquids are known in the art for suspending materials such as beads in liquid cleaning compositions. The methods of providing structure to the liquid includes using particular surfactants to structure the liquid, or by the addition of structuring agents such as polymers, natural gums and clays which enable the liquid to suspend materials therein for long periods of time. These suspended materials can be functional, aesthetic or both. By aesthetic it is meant that the suspended materials impart a certain visual appearance that is pleasing or eye catching. By functional it is meant that the suspended materials contribute to the action of the composition in cleaning, fragrance release, shine enhancement, or other intended action of the composition.

The suspension of materials, however, in a structured cleaning liquid composition by the aforementioned use of surfactants, polymers, natural gums and clays has characteristics that consumers often do not associate with acceptable liquid dish detergents. Conventional structured liquids are often opaque or turbid thereby obscuring the visual appeal to the consumer of the suspended materials which are shown to best advantage in a nearly transparent or clear liquid.

Further, a side effect of structuring a liquid to suspend materials is that it causes a significant increase in liquid viscosity and a corresponding decrease in liquid pourability and ease of dissolution in water. Both properties are generally not considered consumer acceptable, particularly, in liquid cleaning products like hand dishwashing liquid. Finally, the dissolution rate of the structured liquid in water is desired to be rapid so that foam generation is not delayed. Foam is a signal to consumers that the detergent is high quality. Pourability and dissolution are in part linked to liquid viscosity.

When structuring a liquid detergent with a high surfactant content, the ionic strength of the surfactants can cause a collapse of structuring agents that can be included to provide structure to the liquid. To overcome the collapse of the structuring agents, a higher amount of structuring agents may be required, but this can reduce the water dispersability of the liquid detergent and increase the cost. Therefore, it would be desirable to provide a structured liquid that can suspend particles and still have a desired pourability and dissolution rate.

BRIEF SUMMARY

Figure 1:
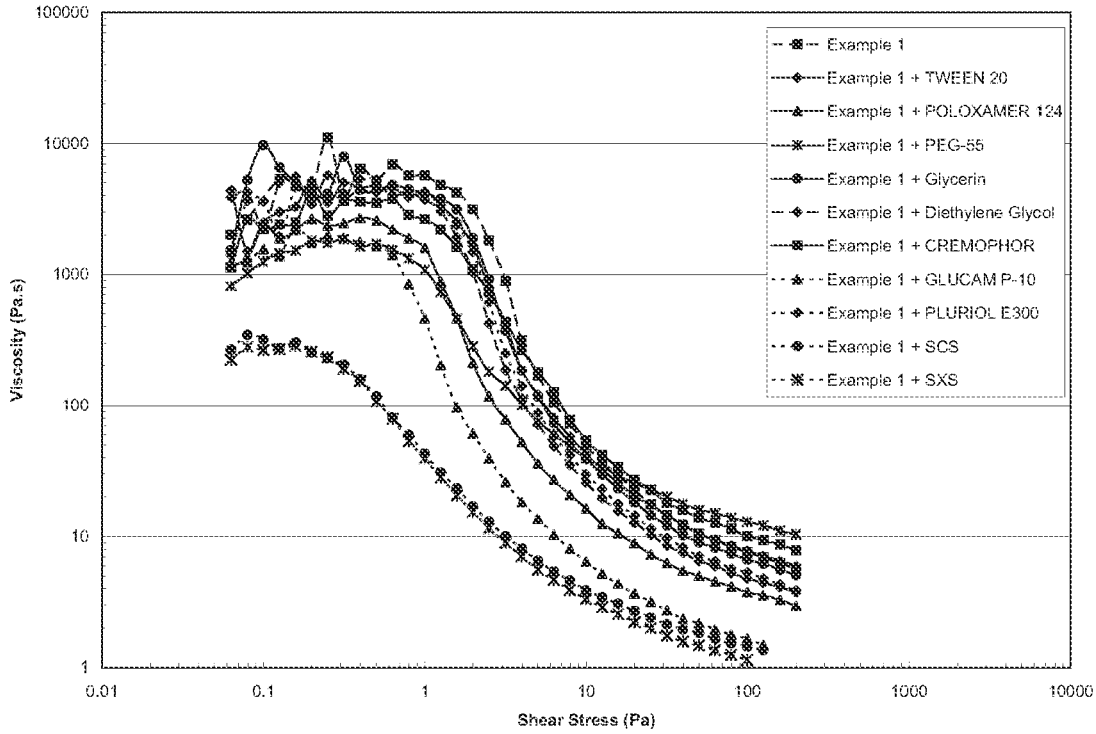
FIG. 1 is a graph of viscosity (Pa s) versus shear stress (Pa) for a composition of the invention with different viscosity control agents.

A composition comprising a liquid portion comprising at least one surfactant and at least one material chosen from at least one suspending agent and at least one viscosity control agent, wherein a) the composition has an apparent viscosity under a shear stress of 0.5 Pa of at least about 1,000 Pa·s; and b) the composition has an apparent viscosity under a shear stress of 100 Pa of less than about 10 Pa·s.

DETAILED DESCRIPTION

As used throughout, ranges are used as shorthand for describing each and every value that is within the range. Any value within the range can be selected as the terminus of the range.

Unless otherwise stated, references to weight % in this specification are on an active basis in the total composition. The active weight of a material is the weight of the material itself excluding water or other materials that may be present in the supplied form of the material. References to molecular weight are to weight average molecular weight.

The composition comprises at least one surfactant in a liquid portion and suspended material. The liquid portion refers to the part of the composition that is not the suspended material. The combination of the suspended material in the composition provides a desired aesthetic appearance. The composition is formulated to provide for the following combination of properties: the ability to suspend materials and a desirable pourable viscosity.

The suspended material can be density matched to the liquid portion if very low viscosity is desired. Density matched means that the density of the suspended material is close to the density of the liquid portion so that the suspended material remains suspended. In one embodiment, the density of the suspended material has a density that is 97% to 103% of the density value of the liquid portion. Alternatively, the suspended material can be non-density matched to the liquid portion.

The composition can be formulated to be any type of detergent composition. The composition can be used as a light duty liquid (LDL) dish detergent, hand liquid soap, body wash, or a liquid laundry detergent. One embodiment described below will be for a hand dish detergent.

Suspending Agents

The selection of the suspending agent is affected by the ionic strength of the composition. As the amount of ionic material increases (such as anionic surfactants), more suspending agent is generally needed. In certain embodiments, a polymeric suspending agent can be selected to have a level of crosslinking to give a desired viscosity, pourability, and dispersability to the composition.

Suspending agents are any material that increases the ability of the composition to suspend material. Examples of suspending agents include, but are not limited to, synthetic suspending agents, gellan gum, polymeric gums, polysaccharides, pectine, alginate, arabinogalactan, carageenan, xanthum gum, guar gum, rhamsan gum, furcellaran gum, and other natural gum.

A synthetic suspending agent in one embodiment is an acrylic polymer, such as a polyacrylate. One acrylate aqueous solution used to form a stable suspension of the solid particles is manufactured by Noveon as CARBOPOL™ Aqua 30. Another acrylate that can be used is CARBOPOL™ Aqua SF1. The CARBOPOL™ resins, also known as CARBOMER™, CARBOPOL™ EZ4, and ULTREZ™ 10, are hydrophilic high molecular weight, crosslinked acrylic acid polymers having an average equivalent weight per carboxylic acid function of 76, and the general structure illustrated by the following formula has a molecular weight of about 1,250,000; CARBOPOL™ 940 with a molecular weight of approximately 4,000,000 and CARBOPOL™ 934 with a molecular weight of approximately 3,000,000. The CARBOPOL™ resins can be crosslinked with polyalkenyl polyether, e.g. about 1% of a polyalkyl ether of sucrose having an average of about 5.8 alkyl groups for each molecule of sucrose. Another acrylate polymer that can be used is ACULYN™ 38 acrylate vinylneodecanoate crosspolymer from Rohm & Haas. Other polyacrylates are ACUSOL™ 820 from Rohm and Haas, and RHEOVIS™ ATA and RHEOVIS™ ATN from Ciba.

ACULYN™ 38 acrylate vinylneodecanoate crosspolymer swells in water; however, its unfolding is limited by the degree of crosslinking, which leads to a sponge-like microstructure. As a result, the water solubilization of the finished product is significantly improved.

The suspending agents can be used alone or in combination. The amount of suspending agent can be any amount that provides for a desired level of suspending ability. In one embodiment, the suspending agent is present in an amount about 0.01 to about 10% by weight of the composition. In other embodiments, the amount is less than about 6, less than about 5, less than about 4, less than about 3, less than about 2.5, less than about 2, less than about 1.5, or less than about 1% by weight of the composition.

Another factor that can be used to select the amount of suspending material is the selection of the surfactants in the composition. Compositions comprising anionic surfactant (ether sulfate or alcohol sulfate, for example), amine oxide and nonionic surfactants can deliver excellent cleaning and foaming properties while keeping the ionic strength under control, which affects the amount of suspending agent needed to give the desired suspending and flow properties. Additionally, these compositions accept up to about 4% or more of an oil, such as diisopropyl adipate (DIA) or dibutyl adipate (DBA), which generates a microemulsion structure that can increase the performance of the composition, mainly in neat usage.

In one embodiment, the ratio of anionic surfactant to amine oxide surfactant can be 100:0 to about 25:75. In another embodiment, the ratio is about 40:60.

Viscosity Control Agents

In addition to the suspending agent, a viscosity control agent is included to modify the composition to obtain a desired viscosity of the composition at rest so that materials can be suspended and to allow a desired flow and dissolution of the composition when dispensed from a container and used.

Examples of the viscosity control agent include, but are not limited to, polypropylene glycol, materials containing propylene oxide groups, materials containing polyethylene oxide groups, polysorbate 20 (TWEEN™20), POLOXAMER™ 124 (PLURONIC™ L44) polyethylene oxide-polypropylene oxide block copolymer having the formula (EO)x(PO)y (EO)z with x=11±3, z=11±3 and y=21±5, POLOXAMER™ L35, POLOXAMER™ L31, polyethylene glycol 55 (PEG-55), glycerin, diethylene glycol, CREMOPHOR™ polyoxyethyleneglyceroltriricinoleat, GLUCAM™ P-10 propylene glycol ether of methyl glucose with 10 polypropylene oxide units, PLURIOL™ E300 alkoxylates based on ethylene oxide and propylene oxide, sodium cumene sulfonate (SCS), sodium xylene sulfonate (SXS), GLUCAM™ P-20 propylene glycol ether of methyl glucose with 20 polypropylene oxide units, GLUCAM™ E-20 ethylene glycol ether of methyl glucose with 20 polyethylene oxide units, GLUCAM™ E-10 ethylene glycol ether of methyl glucose with 10 polyethylene oxide units, and short chain ethoxylated propoxylated alcohols such as PPG2-Buteth-3, PPG3-Buteth-5, or PPG5-Buteth-7.

The amount of the viscosity control agent can be any desired amount to obtain the desired viscosity of the composition. In certain embodiments, the amount is about 0.01 to about 10% by weight of the composition. In other embodiments, the amount is about 1 to about 5%, about 1.5 to about 4.5, 1%, 2%, 3%, 4%, 5%, 6%, 7%, 8%, or 9%.

In one embodiment, the viscosity control agent contains propylene oxide groups. In one embodiment, the viscosity control agent comprises polypropylene glycol. The polypropylene glycol can have any weight average molecular weight to give the desired viscosity. In one embodiment, the molecular weight is about 200 to about 5000. In other embodiments, the molecular weight is about 200 to about 800, about 400, about 1500 to about 2500 or about 2000.

In other embodiments, the polypropylene glycol material can contain hydrophilic groups, such as ethylene oxide groups, glucose (such as in the GLUCAM™ P-10 and P-20), and sorbitan. In another embodiment, the viscosity control agent is an EO-PO-EO block copolymer, such as the POLOXAMER™ 124.

In one embodiment, CARBOPOL™ Aqua 30 is selected as the suspending agent and GLUCAM™ P-10 propylene glycol ether of methyl glucose with 10 polypropylene oxide units is selected as the viscosity control agent. In another embodiment, the amount of CARBOPOL™ Aqua 30 is about 2 to about 3% by weight of the composition, and the amount of GLUCAM™ P-10 is about 3.5 to about 4.5% by weight of the composition. In another embodiment, the amounts are about 2.4% and about 4%, respectively.

Liquid Viscosity

The composition has a viscosity that allows the composition to be pourable, which is usually below 10 Pa·s, but higher viscosities can be used. Viscosity is measured using a Brookfield RVT Viscometer using spindle 2 at 20 RPM at 25° C. In one embodiment, the viscosity is less than 5 Pa·s. In other embodiments, the viscosity is less than 1.5 Pa·s, less than 1 Pa·s, less than 0.750 Pa·s, or less than 0.500 Pa·s. In another embodiment, such as when the composition is dispensed through a foaming pump dispenser, the viscosity can be selected to be less than about 0.100 Pa·s, and in other embodiments, less than about 0.080 or less than about 0.075 Pa·s.

When a suspending agent provides a 3-dimensional network with a long relaxation time, desired results for stability, pourability, and dispersability can be achieved in the composition. The determination of the relaxation time by conventional rheological techniques is difficult to measure. The desired effect for physical stability, however, can be measured the apparent viscosity "seen" by suspended material in the composition. The suspended material applies a stress on the network. To this stress corresponds an apparent viscosity. This viscosity is the one to be taken into account in the calculation of the settling velocity of the particle under Stokes' law. For example, under one g, a 1 mm spherical particle with a density difference of 100 kg/m$^3$ develops a stress that is about 0.5 Pa.

The composition can achieve an apparent viscosity under a shear stress of 100 Pa of less than about 10 Pa·s. In certain embodiments the value is less than about 7, less than about 6, less than about 5, less than about 4, less than about 3, less than about 2.5, less than about 2, or less than about 1 Pa·s. Viscosity measurements are carried out on a RHEOMETRICS™ AR 550 rheometer (TA Instruments) using a 40 mm diameter stainless steel cone and plate geometry with a cone angle of 2 degrees, equipped with a solvent trap to avoid evaporation during the test. Temperature is fixed at 25° C. Test procedure: The sample is allowed to relax for five minutes after loading, then it is submitted to a stress of 0.063 Pa for 30 seconds, after which the apparent viscosity is measured. Then the stress is increased stepwise to 200 Pa, following an exponential rate of 10 steps per decade, each step lasting for 30 seconds. The apparent viscosity is recorded after each step and plotted against the stress on a log-log scale.

In other embodiments, the apparent viscosity under a shear stress of 0.5 Pa is at least about 1,000 Pa·s. In other embodiments, this value is at least about 1,500, at least about 2,000, at least about 3,000, at least about 4,000 Pa·s. In other embodiments, this value is about 1,000 to about 5,000 Pa·s.

Dispersibility of the Composition

Dispersibility is measured by the following method. About 1 g of composition is introduced into 200 g of artificial water (having a 150 ppm water hardness) at 40° C. while avoiding any contact with the beaker wall and the axial flow propeller, which are used for the dispersibility measurements. After addition, the impeller and the chronometer are started. The impeller speed is set at 50 rpm for 1 minute and is progressively increased in steps of 50 rpm every minute until complete dissolution of the dish liquid. The recorded time divided by the real added amount of composition is the time needed to completely dissolve 1 g of liquid.

Detailed procedure:

1. Heat 200 g artificial water in a 400 ml glass beaker.
2. Introduce the axial flow propeller in the beaker containing the heated water (the lower part of the propeller is set at 0.5 cm from beaker bottom).
3. Introduce about 1 g of composition into the heated water while avoiding any contact with the beaker wall or the axial flow propeller.
4. Start the impeller at 50 rpm and start the chronometer. The impeller speed is set at 50 rpm for 1 minute.
5. Increase the speed in steps of 50 rpm every minute until complete dissolution of the composition.
6. Divide the recorded time by the real weighted amount of the composition.

In certain embodiments, such as when the composition is used as a dish liquid, the composition can be dispersed in water according to the dispersion test in less than about 5 minutes. In other embodiments, the time is less than about 4 minutes, less than about 3 minutes, less than about 2.5 minutes, less than about 2 minutes, or less than 1 minute.

Suspended Materials

At least a portion of the suspended material is of any size that is viewable by a person. By viewable it is meant that the suspended material can be seen by a non-color blind person with an unaided eye at 20/20 or corrected to 20/20 with glasses or contact lenses at a distance of 30 cm from the composition under incandescent light, fluorescent light, or sunlight. In other embodiments, at least 50%, at least 60%, at least 70%, at least 80%, at least 90%, at least 95%, or at least 99% of the particles are viewable by a person. In one embodiment, the particle size is 100 to 2500 microns in a longest dimension of the suspended material. In another embodiment, the particle size is 250 to 2250 microns. In another embodiment, the particle size is 500 to 1500 microns. In another embodiment, the particle size is 700 to 1000 microns. In another embodiment, a combination of more than one particle sizes can be used. In another embodiment, there is a combination of five particle sizes.

The suspended material can have any shape. Examples of shapes include, but are not limited to, spherical, polyhedral, cubic, box, tetrahedral, irregular three dimensional shapes, flat polygons, triangles, rectangles, squares, pentagons, hexagons, octagons, stars, characters, animals, plants, objects, cars, or any other desired shape.

The suspended material can be present in any amount in the composition that allows the suspended material to remain suspended. In one embodiment, the suspended material is present in an amount of 0.01 and 10% by weight of the total composition.

The suspended material can be selected to be of one size and one shape, one size and a combination of shapes, a combination of sizes and one shape, or a combination of sizes and a combination of shapes. Also, the color of the suspended material can be varied along with the size and/or shape. Mixtures of suspended materials that vary by size, shape, and/or color can be used to communicate different attributes that the product can deliver to a consumer.

The suspended material should be insoluble in the composition. The suspended material can be functional, non-functional, or a combination of both. They can be made from a variety of materials such as the following non-limiting examples: gelatin, cellulose, agar, waxes, polyethylene, and insoluble inorganic materials such as silica and calcium carbonate, gelatin-gum Arabic coacervates, ground apricot kernels, mica, collagen, polypeptides, and glycosaminoglycan. The material may also have an encapsulate core containing hydrophobic compounds and mixtures such as these non-limiting examples: aloe, vitamins, essential oils, natural oils, solvents, esters, or any fragrance ingredient. These materials may be density matched by encapsulating oils or other materials that help make the density of the suspended material equal to that of the bulk composition. Alternatively, they may be made porous in a way that allows the liquid portion to diffuse into the suspended material in a manner that is self density matching. Density matching produces compositions that can suspend material at a viscosity less than 1.500 Pa·s. Also, the particles may be non-density matched, that is being either less or more dense than the composition. In these compositions, the liquid portion can be designed to have a yield stress to aid in the stabilization of suspended material.

While the composition can be formulated to suspend material without the need of a suspending agent, suspending agents can be added to increase the stability of the suspended material to keep the material suspended. The composition can be stored in warehouses anywhere in the world. Temperatures can range from very cold to very hot. As temperatures change, the density of the liquid may be different from the density of the suspended material. The composition can be formulated to keep the suspended matter suspended at both temperature extremes.

Stability of Suspended Particles

The composition can keep the suspended materials suspended for at least 2 weeks at room temperature (23-25° C.).

By suspended it is meant that at least 90%, or at least 95%, or at least 97%, or at least 99% of the suspended material remains suspended in the composition without settling out to the bottom and without rising at the top of the liquid portion. This can be measured by counting the number of particles that remain suspended in the liquid portion after the elapse of time as compared to the number of particles in the liquid portion initially. In other embodiments, the suspended material can be suspended for at least two months, at least six months, or at least one year at room temperature (23-25° C.). In other embodiments, the composition can keep the suspended materials suspended for at least 12 weeks at 35° C. and 43° C. In another embodiment, the composition can keep the suspended material suspended for at least 12 weeks at 4° C. While factors such as the amount of surfactant, the size of the suspended materials, and the amount of suspending agent can affect stability, amounts for each of these factors can be selected so that the above stability tests are met. It is desired that the suspended material be physically stable during the whole ageing period, at the four temperatures; this means that particles should undergo no physical changes such as change of shape, of color, or no release of loaded ingredients, which would indicate an interaction with the liquid portion.

Liquid Portion

The composition contains at least one surfactant that is present in an amount that is at least 10% by weight of the composition based on the active amount of the surfactant. In other embodiments, the amount of surfactant is at least 15%, at least 20%, at least 25%, at least 30%, at least 35%, or at least 40% by weight. In another embodiment, the amount of surfactant ranges from 10% to 45% by weight. The surfactant can be any surfactant or any combination of surfactants. Examples of surfactants include anionic, nonionic, cationic, amphoteric, or zwitterionic.

Anionic surfactants include, but are not limited to, those surface-active or detergent compounds that contain an organic hydrophobic group containing generally 8 to 26 carbon atoms or generally 10 to 18 carbon atoms in their molecular structure and at least one water-solubilizing group selected from sulfonate, sulfate, and carboxylate so as to form a water-soluble detergent. Usually, the hydrophobic group will comprise a $C_8$-$C_{22}$ alkyl, or acyl group. Such surfactants are employed in the form of water-soluble salts and the salt-forming cation usually is selected from sodium, potassium, ammonium, magnesium and mono-, di- or tri-$C_2$-$C_3$ alkanolammonium, with the sodium, magnesium and ammonium cations again being the usual ones chosen.

The anionic surfactants that are used in the composition of this invention are water soluble and include, but are not limited to, the sodium, potassium, ammonium, and ethanolammonium salts of linear $C_8$-$C_{16}$ alkyl benzene sulfonates, alkyl ether carboxylases, $C_{10}$-$C_{20}$ paraffin sulfonates, $C_8$-$C_{25}$ alpha olefin sulfonates, $C_8$-$C_{18}$ alkyl sulfates, alkyl ether sulfates and mixtures thereof.

The paraffin sulfonates (also known as secondary alkane sulfonates) may be monosulfonates or di-sulfonates and usually are mixtures thereof, obtained by sulfonating paraffins of 10 to 20 carbon atoms. Commonly used paraffin sulfonates are those of $C_{12}$-$C_{18}$ carbon atoms chains, and more commonly they are of $C_{14}$-$C_{17}$ chains. Paraffin sulfonates that have the sulfonate group(s) distributed along the paraffin chain are described in U.S. Pat. Nos. 2,503,280; 2,507,088; 3,260,744; and 3,372,188; and also in German Patent 735.096. Such compounds may be made to specifications and desirably the content of paraffin sulfonates outside the C14-17 range will be minor and will be minimized, as will be any contents of di- or poly-sulfonates. Examples of paraffin sulfonates include, but are not limited to HOSTAPUR™ SAS30, SAS 60, SAS 93 secondary alkane sulfonates from Clariant, and BIO-TERGE™ surfactants from Stepan, and CAS No. 68037-49-0.

Pareth sulfate surfactants can also be included in the composition. The pareth sulfate surfactant is a salt of an ethoxylated $C_{10}$-$C_{16}$ pareth sulfate surfactant having 1 to 30 moles of ethylene oxide. In some embodiments, the amount of ethylene oxide is 1 to 6 moles, and in other embodiments it is 2 to 3 moles, and in another embodiment it is 2 moles. In one embodiment, the pareth sulfate is a $C_{17}$-$C_{13}$ pareth sulfate with 2 moles of ethylene oxide. An example of a pareth sulfate surfactant is STEOL™ 23-2S/70 from Stepan, or (CAS No. 68585-34-2).

Naturally derived alkyl chains can also be used, such as laureth sulfate, as well as non ethoxylated alcohol sulfates like lauryl sulfate.

Examples of suitable other sulfonated anionic detergents are the well known higher alkyl mononuclear aromatic sulfonates, such as the higher alkylbenzene sulfonates containing 9 to 18 or preferably 9 to 16 carbon atoms in the higher alkyl group in a straight or branched chain, or $C_{8-15}$ alkyl toluene sulfonates. In one embodiment, the alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Materials that can be used are found in U.S. Pat. No. 3,320,174, especially those in which the alkyls are of 10 to 13 carbon atoms.

Other suitable anionic surfactants are the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. In one embodiment, olefin sulfonates contain from 14 to 16 carbon atoms in the R alkyl group and are obtained by sulfonating an a-olefin.

Examples of satisfactory anionic sulfate surfactants are the alkyl sulfate salts and the and the alkyl ether polyethenoxy sulfate salts having the formula $R(OC_2H_4)_n\ OSO_3M$ wherein n is 1 to 12, or 1 to 5, and R is an alkyl group having about 8 to about 18 carbon atoms, or 12 to 15 and natural cuts, for example, $C_{12-14}$ or $C_{12-16}$ and M is a solubilizing cation selected from sodium, potassium, ammonium, magnesium and mono-, di- and triethanol ammonium ions. The alkyl sulfates may be obtained by sulfating the alcohols obtained by reducing glycerides of coconut oil or tallow or mixtures thereof and neutralizing the resultant product.

The ethoxylated alkyl ether sulfate may be made by sulfating the condensation product of ethylene oxide and $C_{8-18}$ alkanol, and neutralizing the resultant product. The ethoxylated alkyl ether sulfates differ from one another in the number of carbon atoms in the alcohols and in the number of moles of ethylene oxide reacted with one mole of such alcohol. In one embodiment, alkyl ether sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol.

Other suitable anionic detergents are the $C_9$-$C_{15}$ alkyl ether polyethenoxyl carboxylates having the structural formula $R(OC_2H_4)_nOX$ COOH wherein n is a number from 4 to 12, or 6 to 11 and X is selected from the group consisting of $CH_2$, $C(O)R_1$ and

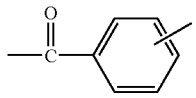

wherein $R_1$ is a $C_1$-$C_3$ alkylene group. Types of these compounds include, but are not limited to, $C_9$-$C_{11}$ alkyl ether polyethenoxy (7-9) $C(O)CH_2CH_2COOH$, $C_{13}$-$C_{15}$ alkyl ether polyethenoxy (7-9)

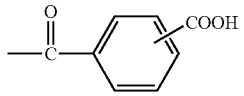

and $C_{10}$-$C_{12}$ alkyl ether polyethenoxy (5-7) $CH_2COOH$. These compounds may be prepared by condensing ethylene oxide with appropriate alkanol and reacting this reaction product with chloracetic acid to make the ether carboxylic acids as shown in U.S. Pat. No. 3,741,911 or with succinic anhydride or phtalic anhydride.

The amine oxide is depicted by the formula:

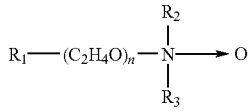

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms; $R_2$ and $R_3$ are each methyl, ethyl, propyl, isopropyl, 2-hydroxyethyl, 2-hydroxypropyl, or 3-hydroxypropyl; and n is from 0 to about 10. In one embodiment, the amine oxides are of the formula:

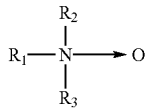

wherein $R_1$ is a $C_{12-18}$ alkyl and $R_2$ and $R_3$ are methyl or ethyl. The above ethylene oxide condensates, amides, and amine oxides are more fully described in U.S. Pat. No. 4,316,824. In another embodiment, the amine oxide is depicted by the formula:

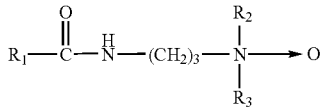

wherein $R_1$ is a saturated or unsaturated alkyl group having 6 to 24 carbon atoms, $R_2$ is a methyl group, and $R_3$ is a methyl or ethyl group. The preferred amine oxide is cocoamidopropyl-dimethylamine oxide.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a PLURAFAC™ surfactants (BASF) and condensates of ethylene oxide with sorbitan fatty acid esters such as the TWEEN™ surfactants (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic surfactant class includes the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

In one embodiment, the nonionic surfactants are the NEODOL™ ethoxylates (Shell Co.), which are higher aliphatic, primary alcohol containing 9-15 carbon atoms, such as $C_9$-$C_{11}$ alkanol condensed with 2.5 to 10 moles of ethylene oxide (NEODOL™ 91-2.5 OR-5 OR-6 OR-8), $C_{12}$-$C_{13}$ alkanol condensed with 6.5 moles ethylene oxide (NEODOL™ 23-6.5), $C_{12}$-$C_{15}$ alkanol condensed with 12 moles ethylene oxide (NEODOL™ 25-12), $C_{14-15}$ alkanol condensed with 13 moles ethylene oxide (NEODOL™ 45-13), and the like.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$-$C_{15}$ secondary alkanol condensed with either 9 EO (TERGITOL™ 15-S-9) or 12 EO (TERGITOL™ 15-S-12) marketed by Union Carbide.

Other suitable nonionic surfactants include the polyethylene oxide condensates of one mole of alkyl phenol containing from about 8 to 18 carbon atoms in a straight- or branched chain alkyl group with about 5 to 30 moles of ethylene oxide.

Specific examples of alkyl phenol ethoxylates include, but are not limited to, nonyl phenol condensed with about 9.5 moles of EO per mole of nonyl phenol, dinonyl phenol condensed with about 12 moles of EO per mole of phenol, dinonyl phenol condensed with about 15 moles of EO per mole of phenol and di-isoctylphenol condensed with about 15 moles of EO per mole of phenol. Commercially available nonionic surfactants of this type include IGEPAL™ CO-630 (nonyl phenol ethoxylate) marketed by GAF Corporation.

Also among the satisfactory nonionic surfactants are the water-soluble condensation products of a $C_8$-$C_{20}$ alkanol with a heteric mixture of ethylene oxide and propylene oxide wherein the weight ratio of ethylene oxide to propylene oxide is from 2.5:1 to 4:1, preferably 2.8:1 to 3.3:1, with the total of the ethylene oxide and propylene oxide (including the terminal ethanol or propanol group) being from 60-85%, preferably 70-80%, by weight. Such detergents are commercially available from BASF and a particularly preferred detergent is a $C_{10}$-$C_{16}$ alkanol condensate with ethylene oxide and propylene oxide, the weight ratio of ethylene oxide to propylene oxide being 3:1 and the total alkoxy content being about 75% by weight.

Condensates of 2 to 30 moles of ethylene oxide with sorbitan mono- and tri-$C_{10}$-$C_{20}$ alkanoic acid esters having a HLB of 8 to 15 also may be employed as the nonionic detergent ingredient in the described composition. These surfactants are well known and are available from Imperial Chemical Industries under the TWEEN™ trade name. Suitable surfactants include, but are not limited to, polyoxyethylene (4) sorbitan monolaurate, polyoxyethylene (4) sorbitan monostearate, polyoxyethylene (20) sorbitan trioleate and polyoxyethylene (20) sorbitan tristearate.

Other suitable water-soluble nonionic surfactants are marketed under the trade name PLURONIC™. The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L 62 and L 64.

The alkyl polysaccharides surfactants, which can be used in the instant composition, have a hydrophobic group containing from about 8 to about 20 carbon atoms, preferably from about 10 to about 16 carbon atoms, or from about 12 to about 14 carbon atoms, and polysaccharide hydrophilic group containing from about 1.5 to about 10, or from about 1.5 to about 4, or from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4-positions rather than at the 1-position, (thus giving e.g. a glucosyl or galactosyl as opposed to a glucoside or galactoside). However, attachment through the 1-position, i.e., glucosides, galactoside, fructosides, etc., is preferred. In one embodiment, the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from 8 to 20, or from 10 to 18 carbon atoms. In one embodiment, the alkyl group is a straight chain saturated alkyl group. The alkyl group can contain up to 3 hydroxy groups and/or the polyalkoxide chain can contain up to 30, or less than 10, alkoxide moieties.

Suitable alkyl polysaccharides include, but are not limited to, decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

In one embodiment, the alkyl polysaccharides are alkyl polyglucosides having the formula $$R^2O(C_nH_{2n}O)_r(Z)_x$$

wherein Z is derived from glucose, $R^2$ is a hydrophobic group selected from alkyl, alkylphenyl, hydroxyalkylphenyl, and mixtures thereof in which said alkyl groups contain from 10 to 18, or from 12 to 14 carbon atoms; n is 2 or 3, r is from 0 to 10; and x is from 1.5 to 8, or from 1.5 to 4, or from 1.6 to 2.7. To prepare these compounds a long chain alcohol ($R^2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucosde content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is generally less than about 2%, or less than about 0.5% by weight of the total of the alkyl polysaccharide. For some uses it is desirable to have the alkyl monosaccharide content less than about 10%.

"Alkyl polysaccharide surfactant" is intended to represent both the glucose and galactose derived surfactants and the alkyl polysaccharide surfactants. Throughout this specification, "alkyl polyglucoside" is used to include alkyl polyglycosides because the stereochemistry of the saccharide moiety is changed during the preparation reaction.

In one embodiment, APG glycoside surfactant is APG 625 glycoside manufactured by the Henkel Corporation of Ambler, Pa. APG25 is a nonionic alkyl polyglycoside characterized by the formula:

$$C_nH_{2n+1}O(C_6H_{10}O_5)_xH$$

wherein n=10 (2%); n=122 (65%); n=14 (21-28%); n=16 (4-8%) and n=18 (0.5%) and x (degree of polymerization)=1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5-10 RPM of 3,000 to 7,000 cps.

The zwitterionic surfactant can be any zwitterionic surfactant. In one embodiment, the zwitterionic surfactant is a water soluble betaine having the general formula

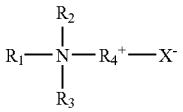

wherein $X^-$ is selected from $COO^-$ and $SO_3^-$ and $R_1$ is an alkyl group having 10 to about 20 carbon atoms, or 12 to 16 carbon atoms, or the amido radical:

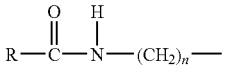

wherein R is an alkyl group having about 9 to 19 carbon atoms and n is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include, but are not limited to, decyl dimethyl betaine or 2-(N-decyl-N,N-dimethyl-ammonia) acetate, coco dimethyl betaine or 2-(N-coco N,N-dimethylammonia) acetate, myristyl dimethyl betaine, palmityl dimethyl betaine, lauryl dimethyl betaine, cetyl dimethyl betaine, stearyl dimethyl betaine, etc. The amidobetaines similarly include, but are not limited to, cocoamidoethylbetaine, cocoamidopropyl betaine and the like. The amidosulfobetaines include, but are not limited to, cocoamidoethylsulfobetaine, cocoamidopropyl sulfobetaine and the like. In one embodiment, the betaine is coco ($C_8$-$C_{18}$) amidopropyl dimethyl betaine. Three examples of betaine surfactants that can be used are EMPIGEN™ BS/CA from Albright and Wilson, REWOTERIC™ AMB 13 and Goldschmidt Betaine L7.

The composition may also contain solvents or salts to modify the cleaning, stability and rheological properties of the composition.

Solvents can include any water soluble solvents. Water soluble solvents include, but are not limited to, $C_{2-4}$ mono, dihydroxy, or polyhydroxy alkanols and/or an ether or diether, such as ethanol, isopropanol, diethylene glycol monobutyl ether, dipropylene glycol methyl ether, diproyleneglycol monobutyl ether, propylene glycol n-butyl ether, propylene glycol, and hexylene glycol, and alkali metal cumene, alkali metal toluene, or alkali metal xylene sulfonates such as sodium cumene sulfonate and sodium xylene sulfonate. In some embodiment, the solvents include ethanol and diethylene glycol monobutyl ether, both of which are miscible with water. Urea can be optionally used at a concentration of 0.1% to 7 weight %.

Salts can include any desirable salt. Examples of salts include, but are not limited to, sodium chloride and magnesium sulfate. The amount of salt should be controlled so that the ionic strength of the composition is not increased so high that the suspending agent collapses.

Additional optional ingredients may be included to provide added effect or to make the product more attractive. Such ingredients include, but are not limited to, perfumes, fragrances, abrasive agents, disinfectants, radical scavengers, bleaches, chelating agents, antibacterial agents/preservatives, optical brighteners, hydrotropes, or combinations thereof.

In some embodiments, preservatives can be used in the composition at a concentration of 0 wt. % to 3 wt. %, more preferably 0.01 wt. % to 15 wt. %. Examples of preservatives include, but are not limited to, benzalkonium chloride; benzethonium chloride,5-bromo-5-nitro-1,3dioxane; 2-bromo-2-nitropropane-1,3-diol; alkyl trimethyl ammonium bromide; N-(hydroxymethyl)-N-(1,3-dihydroxy methyl-2,5-dioxo-4-imidaxolidinyl-N'-(hydroxy methyl)urea; 1-3-dimethyol-5,5-dimethyl hydantoin; formaldehyde; iodopropynl butyl carbamate, butyl paraben; ethyl paraben; methyl paraben; propyl paraben, mixture of methyl isothiazolinone/methyl-chloroisothiazoline in a 1:3 wt. ratio; mixture of phenoxythanol/butyl paraben/methyl paraben/propylparaben; 2-phenoxyethanol; tris-hydroxyethyl-hexahydrotriazine; methylisothiazolinone; 5-chloro-2-methyl-4-isothiazolin-3-one; 1,2-dibromo-2,4-dicyanobutane; 1-(3-chloroalkyl)-3,5,7-triaza-azoniaadam-antane chloride; and sodium benzoate.

Generally, water is included in the composition. The amount of water is variable depending on the amounts of other materials added to the composition.

The compositions can be made by simple mixing methods from readily available components which, on storage, do not adversely affect the entire composition. Mixing can be done by any mixer that forms the composition. Examples of mixers include, but are not limited to, static mixers and in-line mixers. Solubilizing agents such as a $C_1$-$C_3$ alkyl substituted benzene sulfonate such as sodium cumene or sodium xylene sulfonate and mixtures thereof can be used at a concentration of 0.05 wt. % to 10 wt. % to assist in solubilizing the surfactants.

Liquid Clarity

In certain embodiments, the composition can provide a clarity that provides for at least 15% transmittance as measured by the test described below. In other embodiments, the transmittance is >50%, >90%, or up to 100%. The transmittance is measured in the liquid portion. Transmittance is usually decreased by the addition of coloring material (pigments or dyes) to the formula. The addition of any coloring agent to the liquid portion must not decrease the transmittance below the minimum 15% specified. It is unlikely that a colored composition would have a 100% transmittance, although a very pale color in a detergent composition of high clarity can approach this limit.

Color

In certain embodiments, the liquid portion, the suspended material, the container, and the label can each individually be colored or uncolored as long as the suspended material is visually detectable to an observer. Color can be measured by the L* a* b* system established by the Commission Internationale d'Eclairage (CIE). (See for example, McClelland, D., Macworld® Photoshop®4 Bible, IDG Books Worldwide, Inc. 1997, pp. 157-184.) Color can also be measured by the L*C*h° system also established by Commission Internationale d'Eclairage (CIE). This system is very comparable to how human subjects describe colors, representing the terms "lightness", "chroma", and "hue". L* refers to the lightness/darkness of a color. C*, chroma, refers to the intensity of the color, for instance how intensely red the red is. Hue, h°, refers to what people generally refer to as "color"—red, blue, green, orange and is given as an angle. Unlike the L*a*b* system which operates on a standard Cartesian system, L*C*h° operates on a polar coordinate system. Color differences that are significant can be specified by the ΔECMC tolerancing system based on CIELCH and devised by the Color Measurement Committee of the Society of Dyers and Colourists in Great Britain. By this system, it can be seen that there minimum distances between colors for the colors to be seen as different, and these differences vary with hue and chroma.

In one embodiment, it is desired to have a liquid portion hue or container hue that is not complementary to at least a portion of the suspended material hue, that is having a liquid portion hue or container hue that is not 180 degrees away from the suspended material hue on a standard color wheel, or any color visually indistinguishable from the oppositional color. In other embodiments, the liquid portion hue and/or container hue is not complementary to more than 50%, more than 60%, more than 70%, more than 80%, more than 90%, more than 95%, or more than 99% of the suspended material hue. The color of the suspended material can be altered by viewing it through the liquid portion and the package if the color of those items is not completely colorless. When viewed through and surrounded by a complementary color, the color of the suspended material tends to have a strong gray cast, in which the brightness and impact of the suspended material color is less than it could be, which may not be a desired affect. If multiple suspended material colors are used, the liquid portion hue or container hue preferably should not be complementary to any of the suspended material colors. If the liquid portion or container hue is complementary to the suspended color (whether single or multiple suspended material color), then the liquid portion or container color should have the lowest chroma possible. The appearance of the suspended material is more impactful if the chroma of the liquid portion or container is different from the chroma of the suspended material color.

In one embodiment, it is desired that the visual intensity, or chroma, of the colors of the liquid portion and the container are coordinated. The overall transmittance of the liquid portion and container are selected to allow the suspended material to be visible. The transmittance of the liquid portion and that of the container are due to its clarity and its color. It is also desirable to provide visual contrast between the suspended material, the liquid portion, and the container. The chroma of the liquid portion and container can thus be chosen to be different from the chroma of at least a portion of the suspended material. In other embodiments, the chroma of the liquid portion and/or container are different from more than 50%, more than 60%, more than 70%, more than 80%, more than 90%, more than 95%, or more than 99% of the suspended material chroma. This differentiation by chroma can be used if the hue of the suspended material is close to that of the hue of the liquid portion or container so that the suspended material is visually detectable. The clarity of the liquid portion and the clarity of the container should also be maximized so that the maximum light is Pa.ssed to illuminate the suspended material.

The chroma and hue of the liquid portion and that of the container can match or be different depending on the aesthetic effect desired. In one embodiment, the chromas of the liquid portion and the container can be the same as long as the transmittance through the container and the liquid portion meet the stated limits for transmittance. In another embodiment, the hue of the container and the hue of the liquid portion should not be 180 degrees apart from each other on a standard color wheel or any color that is visually indistinguishable from the oppositional color.

Container

The composition can be provided in any type of container that is compatible with the composition. Non-limiting examples of containers are made from plastic or glass. For consumer convenience, plastic may be chosen. The plastic can be any type of plastic. Examples of plastic include, but are not limited to, polyethylene tetra phthalate (PET), polyethylene, polypropylene, or polyvinyl chloride. The plastic bottle preferably does not overly affect the visual impact of the materials. Container properties, such as clarity, gloss, color, and shape can be selected to provide a desired aesthetic effect.

In one embodiment, the container has clarity of at least 15% transmittance as measured by the transmittance test described below. In another embodiment, the transmittance is >50%. and in another embodiment the transmittance is >90% transmittance. The transmittance can be up to 100%.

In one embodiment, the combined transmittance of the container and the liquid portion is at least 15%. In other embodiments, the transmittance can be >50%, >90%, or up to 100%. The transmittance is measured along a longest horizontal path from the front of the container to the rear of the container.

In one embodiment, the container has a gloss of 10 to 500 gloss units as measured at 60 degrees according to the test described below. In another embodiment, the gloss is from 10 to 100 as measured at 60 degrees.

The container can be any color or uncolored. The container can be opaque, but it is preferred that the container is transparent or translucent. In one embodiment, the container is transparent and uncolored. In another embodiment, the container is transparent and colored. In one embodiment, the color intensity is not more than 20 chroma units as measured by the test described below.

The container can be of any desired shape. Types of shapes include, but are not limited to, round, triangular, cylindrical, oval, asymmetrical, or waisted (having defined shoulders and hips). In one embodiment, the container has a shape as the defined by the side to side, front to back and height dimensions below:

| | Max, mm | Min, mm |
|---|---|---|
| Side to Side | 250 | 30 |
| Front to Back | 160 | 30 |
| Height | 350 | 60 |

In one embodiment, the greatest side to side dimension of the container is greater than the greatest front to back dimension of the container. In another embodiment, the height of the container is greater than the greatest front to back dimension and the greatest side to side dimension of the container.

Label

The composition is intended to be distributed to a consumer in a container with a label. The label identifies the brand, manufacturer, and type of product, and it can include any safety or regulatory information, usage instructions, or other useful information. Generally, extensive information must be contained in a limited amount of space. Labels can be opaque, translucent (clear), or have a transmittance between opaque and clear. In one embodiment, the label has transparency of at least 15% transmittance. In other embodiments, the transmittance is >50%, >90%, or up to 100% in areas not covered by printing. The printing on the label can be designed with the same level of transmittance as long as the printing can be read. In one embodiment, the combined transmittance of the label, the container, and the liquid portion is at least 15% in areas not covered by printing. In other embodiments, the transmittance is >50%, >90%, or up to 100% in areas not covered by printing.

The label can be adhered to the container by any desired method. Examples include, but are not limited to, permanent, peel-off, or peel off leaving a residual but smaller portion of the overall label. The label can be textured, contain any desired graphics including a hologram, 3D effects, light reflection, or plain printing.

Closure

The composition can be distributed to the consumer in a container with a closure to prevent spillage and evaporation, and it can aid in dispensing. Any type of closure can be used with the container that allows for the dispensing of the composition. Examples of closures include, but are not limited to, push pull, flip top, spout, valve, or pump type. These allow for easy dispensing. These types can provide for a flow rate of at least 1 ml/sec. (as measured by volume dispensed over time). The closure opening diameter can be adjusted as desired for product viscosity.

Transmittance refers to the amount of light that can be transmitted through an object as a fraction of the incident light. The longer the path length, the more the light intensity detectable on the side opposite the incident light is attenuated. Transmittance can be measured using a Shimadzu UV-160U instrument according to the manufacturer's instructions. A sample to be measured is placed in a 1 cm cuvette and placed in the machine. The wavelength of light used is 720 nm. Transmittance is read directly from the instrument as % transmittance.

Surface gloss is measured by using a Gardner Micro TRI Gloss Meter by following the instructions given for operating the instrument at 60°. For transparent or translucent surfaces a nonreflective black backing is placed under the sample so that transmitted light does not contribute to the gloss measurement.

The following examples illustrate compositions of the invention. Unless otherwise specified, all percentages are by weight. The abbreviation AI refers to the total active ingredient amount of surfactant(s). The exemplified compositions are illustrative only and does no limit the scope of the invention.

Measurements of lightness, chroma, and hue angle are done with an X-Rite SP60 Sphere Spectrophotometer with 4 mm aperture. For transparent or translucent liquids, the instrument is placed in its stand fitted with a holder for a rectangular, 10 mm, Starna glass colorimeter cell. The Starna cell is filled with the sample, the cap placed on top and the cell placed in the holder. The sphere spectrophotometer is triggered to initiate the measurement. Although this method does not give the same results as transmission color measurements, the measurements are correct relative to other measures done by this method so that comparisons of chroma, hue angle and lightness can be done. Therefore, to measure solid samples (such as packaging materials) a sample of the material is cut to fit in the Starna cell and the measurement is done in the same way after placing the sample in the cell. Measurements are done under conditions of the 10° observer and fluorescent light. Optionally, other light sources, such as incandescent or sunlight, can be used if it is desired to optimize the viewing of the composition under those light sources. For standardized measurements, fluorescent lighting is used.

The following examples illustrate compositions of the invention. Unless otherwise specified, all percentages are by weight. The abbreviation AI refers to the total active ingredient amount of surfactant(s). The exemplified compositions are illustrative only and does no limit the scope of the invention.

The compositions can be prepared by mixing of the ingredients. In one embodiment, the order of addition to water is: suspending agent, anionic surfactants, nonionic surfactants, amphoteric surfactants, other ingredients. At some point, the CARBOPOL™ AQUA 30 polymer and similar suspending agents is neutralized to a pH of about 6.3 to about 6.5. The amine oxide in the composition is slightly basic and can help neutralize the polymer. If after surfactant addition, the pH is higher than 6.5, then it is adjusted with an acid (such as HCl or $H_2SO_4$). If the pH is below, it is adjusted with a base (such as NaOH or triethanolamine).

In the examples below, the reference to NaAEOS 2EO refers to C12-C13 alkylethoxysulfate, sodium salt, with an average of 2 EO units, and the reference to $NH_4$AEOS 1.3 EO refers to C12-C15 alkylethoxysulfate, ammonium salt, with an average of 1.3 EO units.

The following examples were made by mixing of the ingredients.

| | Example 1 (20% AI) | Example 2 (20% AI) | Example 3 (34% AI) |
|---|---|---|---|
| CARBOPOL ™ Aqua 30 polymer | 2.6 | 2.6 | 2.6 |
| Na AEOS 2EO | 8 | 0 | 0 |
| Lauryl myristyl dimethyl amine oxide | 12 | 3.75 | 6.4 |
| Sodium linear alkyl benzene sulfonate (NaLAS) | 0 | 2 | 3.5 |
| Magnesium linear alkyl benzene sulfonate (MgLAS) | 0 | 6.25 | 10.6 |
| $NH_4$ AEOS 1.3EO | 0 | 8 | 13.5 |
| Perfume | 0.5 | 0.5 | 0.5 |
| Preservative | 0.1 | 0.1 | 0.1 |
| Water | QS | QS | QS |
| pH | 6.85 | 6.3 | Too thick |

To the composition of Example 1, 5% by weight of water was removed and was replaced by 5% by weight (actual amount) of the following materials: polysorbate 20 (TWEEN™20), POLOXAMER™ 124 polyethylene oxide-polypropylene oxide block copolymer having the formula (EO)x(PO)y(EO)z with x=z=11 and y=21, polyethylene glycol 55 (PEG-55), glycerin, diethylene glycol, CREMOPHOR™ polyoxyethyleneglyceroltriricinoleat, GLUCAM™ P-10 propylene glycol ether of methyl glucose with 10 polypropylene oxide units, PLURIOL™ E300 alkoxylates based on ethylene oxide and propylene oxide, sodium cumene sulfonate (SCS), sodium xylene sulfonate (SXS), and GLUCAM™ P-20 propylene glycol ether of methyl glucose with 20 polypropylene oxide units. The viscosity (Pa s) versus shear stress (Pa) curves obtained for these compositions are shown in FIG. 1.

From these results, the GLUCAM P-10 and P-20 compositions were selected for aging studies. Samples of these compositions were prepared and polyethylene beads were added. The samples were aged for 12 weeks at 4, 25, 35, and 45° C. All samples were stable after 12 weeks.

It appears that materials containing polypropylene glycol chains were more effective than materials containing ethylene oxide chains terminated by alcohol function.

Figure 2:
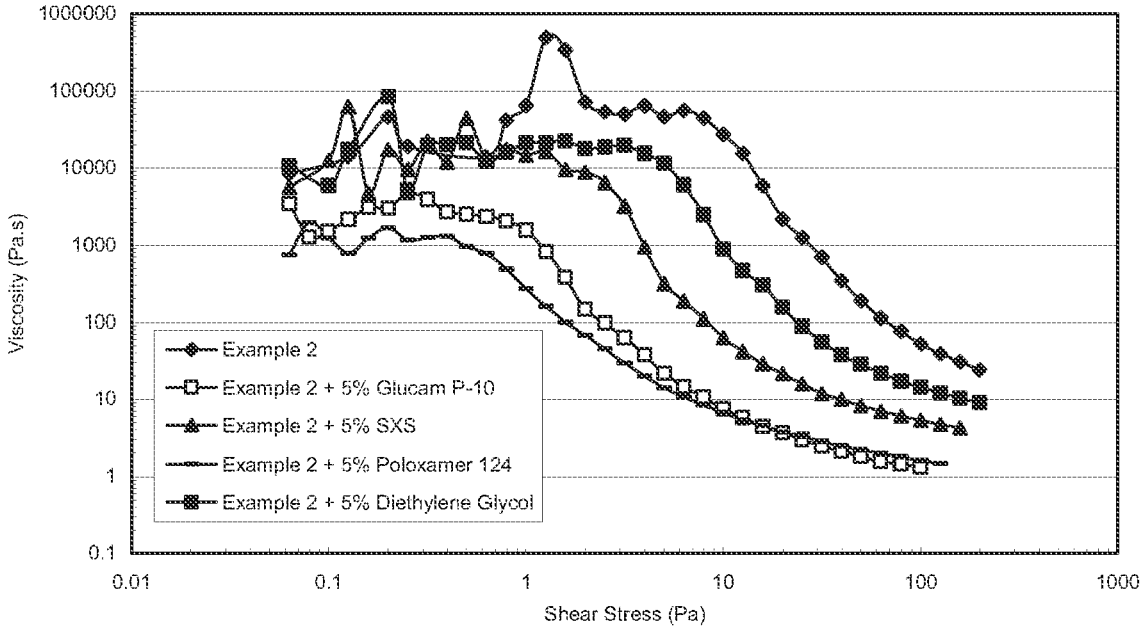
FIG. 2 is a graph of viscosity (Pa s) versus shear stress (Pa) for a composition of the invention with different viscosity control agents.

To the composition of Example 2, 5% by weight of water was removed and was replaced with 5% by weight (actual) of the following materials: GLUCAM™ P-10 propylene glycol ether of methyl glucose with 10 polypropylene oxide units, sodium xylene sulfonate (SXS), POLOXAMER™ 124 polyethylene oxide-polypropylene oxide block copolymer having the formula (EO)x(PO)y(EO)z with x=z=11 and y=21, and diethylene glycol. The viscosity (Pa s) versus shear stress curves obtained for these compositions are shown in FIG. 2.

Based on rheology data, the apparent viscosity at 20 $s^{-1}$ for both surfactant systems was estimated using the following procedure. The test was carried out on a RHEOMETRICS™ AR 550 rheometer (TA Instruments), using a 40 mm diameter stainless steel cone and plate geometry with a cone angle of 2 degrees, equipped with a solvent trap to avoid evaporation during the test. Temperature is fixed at 25° C. After being loaded, the sample is left at rest for 30 seconds. Then it is submitted to a linear shear rate ramp from 0 to 100 reciprocal seconds ($s^{-1}$) in 1 minute ("up" curve). This shear rate is kept for 1 minute ("peak hold"), then the shear rate is decreased to 0 according to a linear ramp in 1 minute ("down" curve). The apparent viscosity is measured at a shear rate of 20 $s^{-1}$ on the "down" curve.

| Composition | GLUCAM ™ P-10 level (%) | Viscosity @ 20 $s^{-1}$ (Pa · s) |
|---|---|---|
| Example 2 | 0 | >10 |
| Example 2bis | 5 | 1.6 |
| Example 1 | 0 | >10 |
| Example 1bis | 5 | 4.0 |

The dispersion time of these compositions were measured by the following dispersion test.

| Composition | GLUCAM ™ P-10 level | Average Dispersion Time (min/g) |
|---|---|---|
| Example 2 | 0 | >10 |
| Example 2bis | 5 | 2:26 |
| Example 1 | 0 | >10 |
| Example 1bis | 5 | 3:53 |

The following compositions were made by mixing of the ingredients.

| | Example 4 | Example 5 | Example 6 |
|---|---|---|---|
| NaAEOS 2EO | 8 | 8 | 8 |
| Lauryl myristyl dimethyl amine oxide | 12 | 12 | 12 |
| POLOXAMER 124/PLURONIC L44 | 4.25 | 3.2 | 5.5 |
| Diisopropyl adipate | 3 | 4 | 0 |
| CARBOPOL ™ Aqua SF1 polymer | 2.59 | 2.2 | 0 |
| ACULYN ™ 38 polymer | 0 | 0 | 2.5 |
| Clarity | Clear | Clear | Clear |
| Dispersion time (min:s) | 7:15 | 5:19 | 3:07 |
| Viscosity at 0.5 Pa (Pa · s) | 5000 | 2000 | 1150 |
| Viscosity at 100 Pa (Pa · s) | 5.0 | 3.1 | 2.45 |

Figure 3:
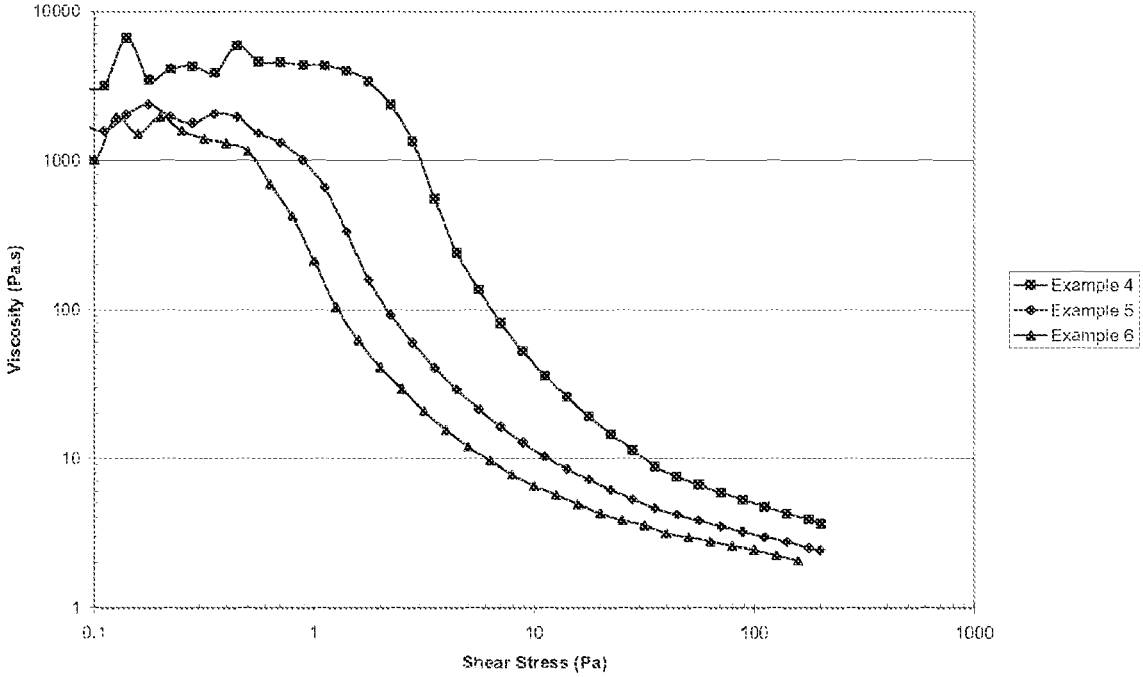
FIG. 3 is a graph of viscosity (Pa s) versus shear stress (Pa) for compositions in Examples 4 to 6.

The viscosity (Pa s) versus shear stress curves obtained for these compositions are shown in FIG. 3. From the results, it can be seen that the lower the viscosity of the composition, the shorter the dispersion time.

The effect of various polypropylene glycols on the viscosity of the liquid portion were also studied. The following examples contain PPG 1000 and PPG 2000, in which the number refers to the molecular weight. They were prepared by mixing of the ingredients.

| | Example 7 | Example 8 |
|---|---|---|
| $NH_4$AEOS 1.3EO | 8 | 8 |
| NaLAS | 2 | 2 |
| MgLAS | 6.25 | 6.25 |
| Lauryl Myristyl Dimethyl Amine Oxide (LMDO) | 3.75 | 3.75 |
| CARBOPOL ™ Aqua 30 polymer | 2.6 | 2.6 |
| PPG 1000 | 5 | 0 |
| PPG 2000 | 0 | 5% |
| Water | Q.S. | Q.S. |

The efficacy of various viscosity control agents in compositions free of suspending agent were examined. In Example 9 below, the formula was prepared by mixing the ingredients and using different viscosity control agents at a level of 4% by weight of each. The viscosity control agents used in this example were sodium cumene sulfonate (SCS), isopropyl alcohol (IPA), POLOXAMER™ 124 (PLURONIC™ L44), POLOXAMER™ L35, POLOXAMER™ L31, GLUCAM™ P-20, GLUCAM™ P-10, GLUCAM™ E-20, and GLUCAM™ E-10.

| | Example 9 |
|---|---|
| Sodium Lauryl Sulfate (SLS) | 6% |
| Lauryl Myristyl Dimethyl Amine Oxide (LMDO) | 14% |
| Di IsoPropyl Adipate (DIPA) | 3.5% |
| Viscosity control agent | 4% |
| Water | Q.S. |

Figure 4:
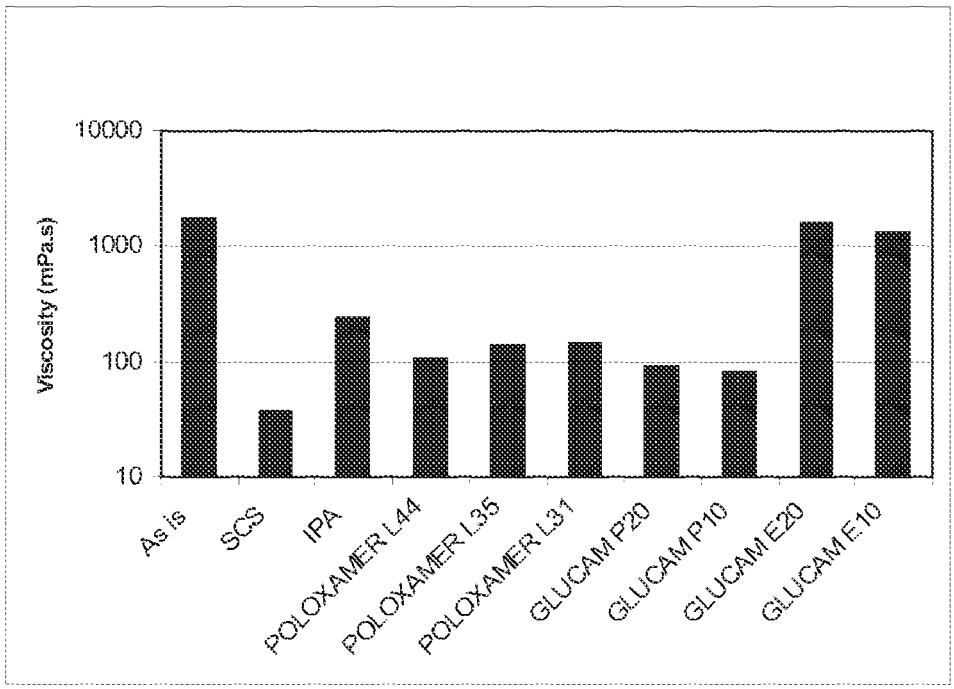
FIG. 4 is a graph of the effect on viscosity by using different viscosity control agents in a composition.

A graph of the viscosity of each of the compositions from Example 9 are shown in FIG. 4. While the ethylene oxide containing GLUCAM™ E-20 and E-10 reduced the viscosity, the propylene oxide containing materials (the POLOXAMER™ materials and the GLUCAM™ P-20 and P-10) were more effective at reducing the viscosity. This experiment demonstrates the very surprising beneficial effect of PPG on reducing viscosity under 100 $s^{-1}$ shear rate.

Figure 5:
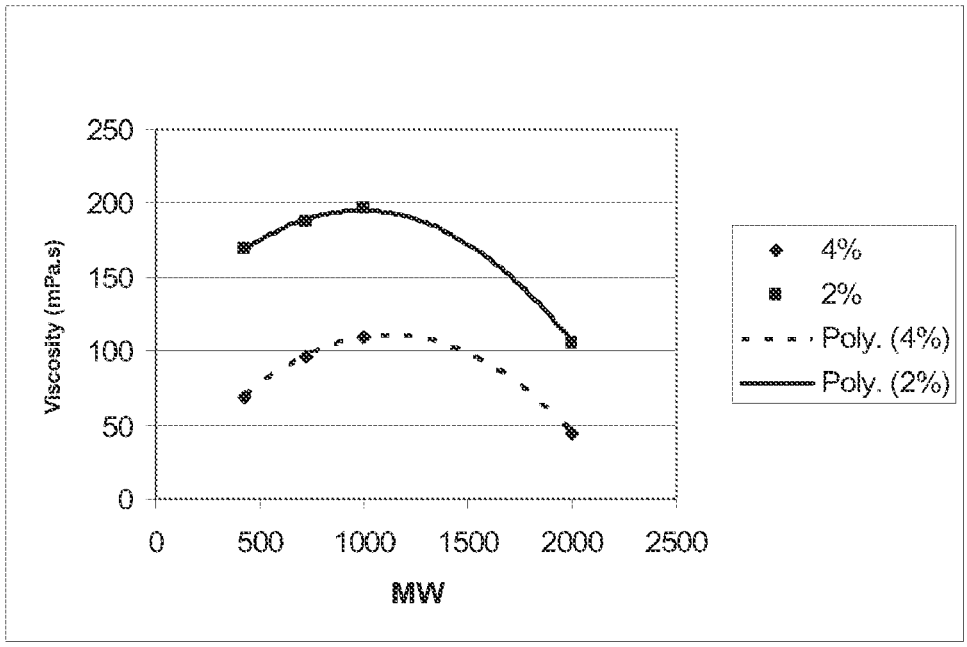
FIG. 5 is a graph on the effect of polypropylene glycol molecular weight on the viscosity of a composition at a 2% and 4% addition level.

In Examples 10 to 14, a composition was prepared with 19% surfactant that was 70/30 (13.3%) lauryl myristyl dimethyl amine oxide/(5.7%) sodium lauryl sulfate, and 3.5% diisopropyl adipate (Example 10) The viscosity of this composition without any viscosity control agents was 1.08 Pa·s. This composition exhibits almost Newtonian behavior. Polypropylene glycols of different molecular weights were added to the composition at a 2% level and a 4% level. The molecular weights of the tested PPGs were 425 (Example 11), 725 (Example 12), 1000 (Example 13) and 2000 (Example 14). The effect on viscosity of the system is shown in FIG. 5. Without being bound to theory, it is theorized that on the lower molecular weight side of the curve that the viscosity effect is due to an entropic effect related to the number of molecules. For the same weight, the lower molecular weight would give more molecules. For the higher molecular weights, it is theorized that the polymer is close to theta conditions, and it can no longer unfold in the water phase, so it migrates towards the micelle palisade on which it adsorbs. This adsorption results in a reduction of the friction forces between micelles, which reduces the viscosity.

Figure 6:
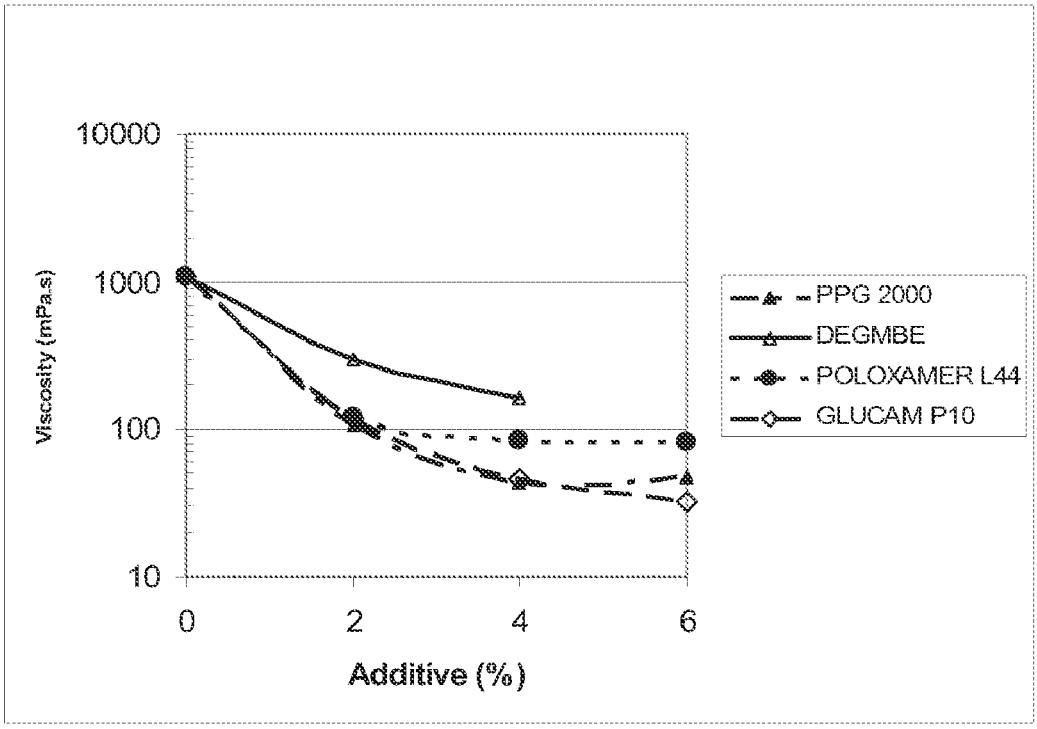
FIG. 6 is a graph of the effect of the level of viscosity control agent in a composition on the viscosity.

In the composition corresponding to Example 10, viscosity control agents were added at various levels to determine the effect on the viscosity. The viscosity control agents used were polypropylene glycol 2000MW (Example 15), diethylene glycol monobutyl ether (DEGMBE) (Example 16), POLOXAMER™ 124 (PLURONIC™ L44) (Example 17), and GLUCAM™ P-10 (Example 18). The results are shown in FIG. 6.

The compositions listed in the following tables were aged in glass jars at four temperatures: 4° C., 25° C., 35° C., and 43° C. for 3 months using different suspended material listed in the table below. Each sample was stable (the suspended material remained suspended) at all four temperatures for three months.

| | Example 4 | Example 5 | Example 1bis |
|---|---|---|---|
| NaAEOS 2EO | 8 | 8 | 8 |
| Lauryl myristyl dimethyl amine oxide | 12 | 12 | 12 |
| POLOXAMER 124/PLURONIC L44 | 4.25 | 3.2 | 0 |
| GLUCAM ™ P10 | 0 | 0 | 5 |
| Diisopropyl adipate | 3 | 4 | 0 |
| CARBOPOL ™ Aqua 30 | 0 | 0 | 2.6 |
| CARBOPOL ™ Aqua SF1 | 2.59 | 2.2 | 0 |
| Physical stability results | | | |
| Karite butter encapsulated beads (gelatin-agar coacervates) from Hall Crest-ISP 1250 μm | Stable 3 months | Stable 3 months | Not tested |
| Apricot kernel particles - Alban Muller - 500-600 μm | Stable 3 months | Stable 3 months | Stable 3 months |
| Lipo Scrub LDB 315 (polyethylene beads from LipoChemicals) | Not tested | Not Tested | Stable 3 months |
| A mixture 50/50 of polyethylene blue-green - 500 μm and polyethylene white - 200-300 μm | Stable 3 months | Stable 3 months | Not tested |

Figure 7:
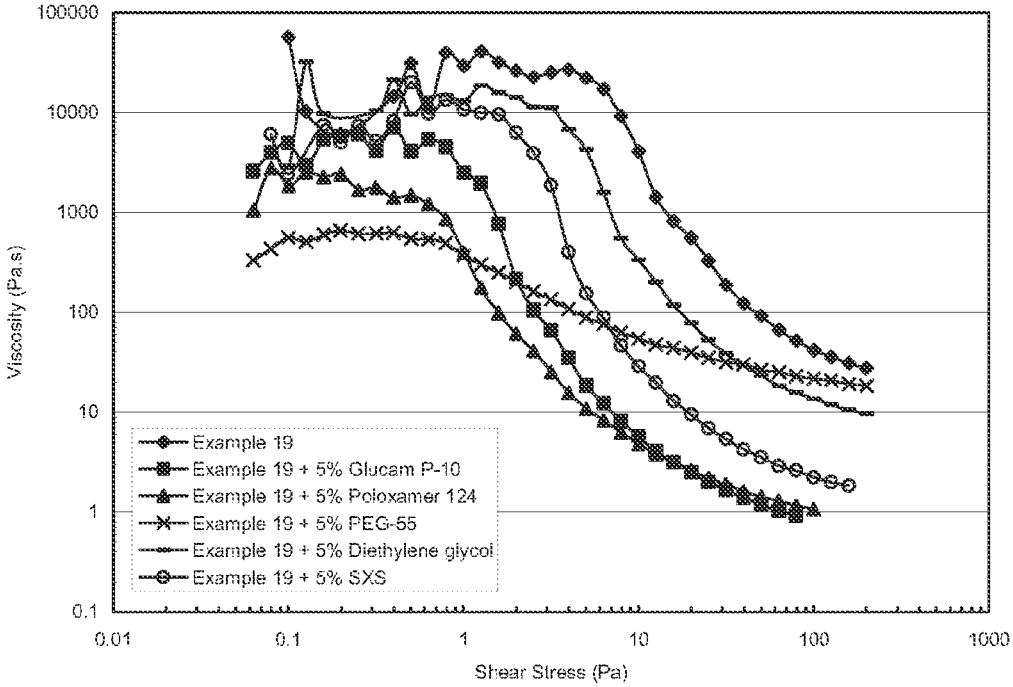
FIG. 7 is a graph of the effect of different viscosity control agents in a composition containing no magnesium salts.

The effect of various viscosity control agents on the viscosity of the liquid portion of several compositions which do not contain any magnesium salt was also studied. In Example 19, there is no magnesium salt in the base composition. The viscosity control agents tested in example 19 were PEG-55 (Example 21), Diethylene Glycol (Example 22), POLOXAMER™ 124 (Example 23), SXS (Example 24), and GLUCAM™ P-10 (Example 25). They were prepared by mixing of the ingredients. The viscosity (Pa·s) versus shear stress (Pa) for Example 19 and the different viscosity control agents is shown in FIG. 7.

| | Example 19 without viscosity control agent | Example 19 with viscosity control agent |
|---|---|---|
| $NH_4$AEOS 1.3EO | 8 | 8 |
| NaLAS | 8.25 | 8.25 |
| MgLAS | 0 | 0 |
| Lauryl Myristyl Dimethyl Amine Oxide (LMDO) | 3.75 | 3.75 |
| CARBOPOL ™ Aqua 30 polymer | 2.6 | 2.6 |
| Viscosity control agent | 0 | 5 |
| Water | Q.S. | Q.S. |

Figure 8:
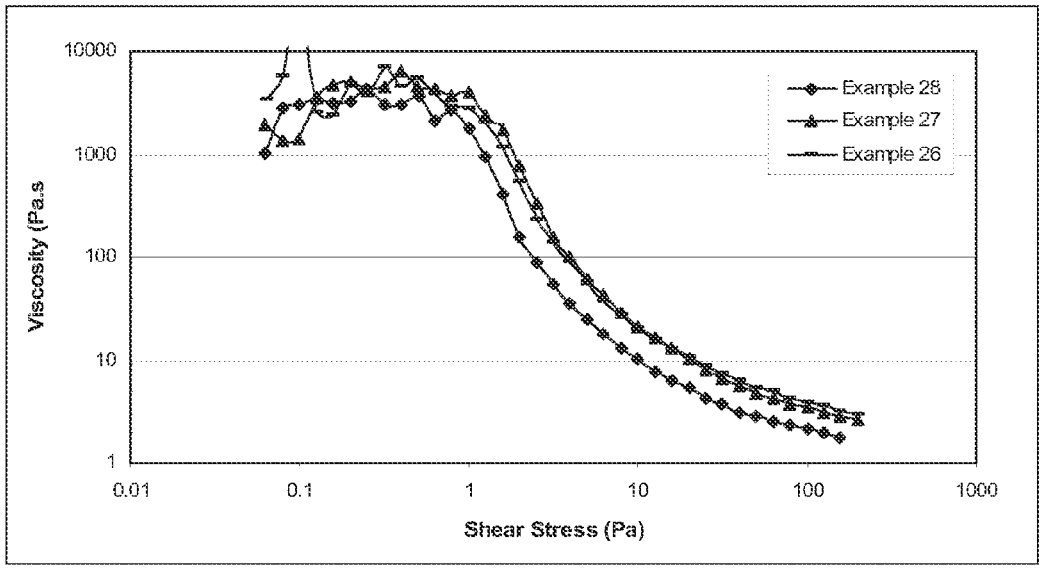
FIG. 8 is a graph of the effect of PPG 400 on different surfactant compositions.

Amongst the tested polyethylene glycols, PPG 400 was efficient for any surfactant systems. The following compositions were made by mixing of the ingredients. The viscosity (Pa·s) versus shear stress (Pa) for these compositions are shown in FIG. 8.

| | Example 26 | Example 27 | Example 28 |
|---|---|---|---|
| $NH_4$AEOS 1.3EO | 11.2 | 0 | 0 |
| NaLAS | 2.8 | 0 | 0 |
| MgLAS | 8.75 | 0 | 0 |
| NaAEOS 2EO | 0 | 8 | 8 |
| Lauryl Myristyl Dimethyl Amine Oxide (LMDO) | 5.25 | 12 | 12 |
| Diisopropyl adipate | 0 | 0 | 3 |
| CARBOPOL ™ Aqua 30 polymer | 2.4 | 2.4 | 2.4 |
| PPG 400 | 2.5 | 5 | 5 |
| Water | Q.S. | Q.S. | Q.S. |

The invention claimed is:

1. A composition comprising a liquid portion comprising a) at least 10% by weight of the composition of a combination of surfactants, wherein at least one surfactant comprises an alkyl benzene sulfonate surfactant, b) 0.01 to about 10% by weight of the composition of at least one suspending agent comprising an acrylic poloymer, and c) 0.01 to about 10% by weight of the composition of at least one viscosity control agent selected from the group consisting of, polyethylene oxide-polypropylene oxide block copolymer having the formula (EO)x(PO)y(EO)z with x=11±3, z=11±3 and y=21±5, propylene glycol ether of methyl glucose with 20 polypropylene oxide units, ethylene glycol ether of methyl glucose with 20 polyethylene oxide units, and ethylene glycol ether of methyl glucose with 10 polyethylene oxide units;

wherein the composition has an apparent viscosity under a shear stress of 0.5 Pa of at least about 1,000 Pa·s, and the composition has an apparent viscosity under a shear stress of 100 Pa of less than about 10 Pa·s.

2. The composition of claim 1, wherein the composition has a viscosity of less than about 10 Pa·s as measured on a Brookfield RVT Viscometer using spindle 2 at 20 RPM at 25° C.

3. The composition of claim 1 further comprising suspended material.

4. The composition of claim 1, wherein the suspending agent comprises an acrylic acid polymer and the viscosity control agent comprises polyethylene oxide-polypropylene oxide block copolymer having the formula (EO)x(PO)y(EO)z with x=11±3, z=11±3 and y=21±5.

5. The composition of claim 1, wherein the suspending agent comprises an acrylic acid polymer and the viscosity control agent comprises propylene glycol ether of methyl glucose with 20 polypropylene oxide units.

6. The composition of claim 1, wherein the suspending agent comprises an acrylic acid polymer and the viscosity control agent comprises ethylene glycol ether of methyl glucose with 20 polyethylene oxide units.

7. The composition of claim 1, wherein the suspending agent comprises an acrylic acid polymer and the viscosity control agent comprises ethylene glycol ether of methyl glucose with 10 polyethylene oxide units.

8. The composition of claim 1, wherein the combination of surfactants comprises additional anionic surfactants, nonionic surfactants, and amphoteric surfactants.

9. The composition of claim 8, wherein the suspending agent comprises an acrylic acid polymer and the viscosity control agent comprises polyethylene oxide-polypropylene oxide block copolymer having the formula (EO)x(PO)y (EO)z with x=11±3, z=11±3 and y=21±5.

10. The composition of claim 8, wherein the suspending agent comprises an acrylic acid polymer and the viscosity control agent comprises propylene glycol ether of methyl glucose with 20 polypropylene oxide units.

11. A method of making the composition of claim 1, comprising mixing the combination of surfactants, the at least one suspending agent, and the at least one viscosity control agent.

12. The composition of claim 1, wherein the suspending agent is present at 2 to 3% by weight of the composition.

* * * * *